United States Patent [19]

Sigourney

[11] Patent Number: 4,913,594

[45] Date of Patent: Apr. 3, 1990

[54] ADJUSTABLE CONNECTION SYSTEM FOR PRECAST FACING PANEL AND SOLDIER PILE

[75] Inventor: James W. Sigourney, Purcellville, Va.

[73] Assignee: Schnabel Foundation Company, Bethesda, Md.

[21] Appl. No.: 158,498

[22] Filed: Feb. 22, 1988

Related U.S. Application Data

[63] Continuation-in-part of Ser. No. 923,472, Oct. 27, 1986, abandoned.

[51] Int. Cl.[4] ..... E02D 29/02

[52] U.S. Cl. ..... 405/285; 405/286

[58] Field of Search ..... 405/258, 262, 284, 285, 405/286, 287, 272; 52/235, 713

[56] References Cited

U.S. PATENT DOCUMENTS

| | | |
|---|---|---|
| 1,965,169 | 7/1934 | Becker . |
| 2,079,478 | 5/1937 | Basch . |
| 2,110,253 | 3/1938 | Zur Nedden . |
| 3,068,656 | 12/1962 | Booth et al. . |
| 3,155,206 | 11/1964 | Booth . |
| 3,236,054 | 2/1966 | Northrup . |
| 3,245,649 | 4/1966 | Cassidy et al. . |
| 3,466,874 | 9/1969 | Holl . |
| 3,802,205 | 4/1974 | Dickinson . |
| 3,815,369 | 6/1974 | Meredith . |
| 4,045,933 | 9/1977 | Grillo . |
| 4,070,835 | 1/1978 | Reverend et al. . |
| 4,073,114 | 2/1978 | Irish . |
| 4,116,010 | 9/1978 | Vidal . |
| 4,272,933 | 6/1981 | Lopes . |
| 4,343,571 | 8/1981 | Price . |
| 4,448,571 | 5/1984 | Eckels . |
| 4,449,857 | 5/1984 | Davis . |
| 4,564,316 | 1/1986 | Hunziker . |
| 4,565,040 | 1/1986 | Kaminaga . |
| 4,596,496 | 6/1986 | Tyrell et al. . |
| 4,607,472 | 8/1986 | Pointner . |

FOREIGN PATENT DOCUMENTS

| | | |
|---|---|---|
| 2102866A | 2/1983 | United Kingdom . |

*Primary Examiner*—David H. Corbin

*Attorney, Agent, or Firm*—Banner, Birch, McKie & Beckett

[57] ABSTRACT

The present invention is directed to a connection system for connecting a facing panel to a soldier pile so as to support the cut face of an excavation and provide greater tolerance for misalignment of the soldier piles with respect to the facing panels. The connection system also provides improved strength, and greater ease of construction. The system includes a first bracket coupled to the facing panel, the bracket having at least one stem portion with a horizontally elongated slot. A similar second bracket with vertically elogated slots in the base portion and a horizontally elongated slot in the stem portion is fixed to the soldier pile by a threaded fastener. A connecting plate connects the stems of the brackets together. Adjustment in the vertical, y-direction is provided by the location of the fastener on the soldier pile and the vertical slots in the first bracket. Adjustment back and forth, that is, in the z-direction, is provided by the location of the base of the first bracket along the length of the fasteners, by the length of the connecting plates, or both. Adjustment in the horizontal, x-direction, is provided by the location of the fasteners on the soldier pile, rotation of the connecting plate between the first and second brackets, and the horizontal slots in the stems of the first and second brackets.

19 Claims, 3 Drawing Sheets

ADJUSTABLE CONNECTION SYSTEM FOR PRECAST FACING PANEL AND SOLDIER PILE

This application is a continuation-in-part of Ser. No. 923,472, filed on Oct. 27, 1986, now abandoned.

TECHNICAL FIELD

The present invention is directed to a connection system for connecting a facing panel to a support and, more particularly, to adjustably connecting a precast concrete facing panel to a soldier pile.

BACKGROUND OF THE INVENTION

Wood planks or concrete panels are often used as facing to retain ground excavations. The facing generally is connected to supports, such as soldier piles, driven or otherwise installed in the ground. However, standard precast concrete connections require that the soldier piles be accurately placed to a tolerance of $\pm\frac{1}{2}$ inch. When driving or drilling pilings into the ground, it is difficult to install the pilings to this tolerance. Misalignment of the soldier piles can be compensated for by erecting a separate welded frame between the piles and the panels. However, the building of such a separate frame is expensive and difficult to construct to required tolerances.

One attempt to overcome the above problem is illustrated in U.S. Pat. Nos. 3,068,656 and 3,155,206 to Booth and Booth et al., respectively. These patents disclose a system for providing vertical adjustment of a connection between soldier piles and a proposed wall of wood plank sheeting. Another way of compensating for some misalignment is to provide connecting members on both the soldier piles and panels which extend toward each other and overlap, such as is disclosed in U.S. Pat. No. 4,653,962.

SUMMARY OF THE INVENTION

It is an object of the present invention to provide a connection system for adjustably connecting facing panels to soldier piles.

It is a further object of the present invention to accomplish the above while permitting three degrees of freedom of adjustment, thus, providing greater tolerance for pile misalignment.

It is a further object of the present invention to accomplish the above for cut walls with all connections behind the back face of the panels.

It is a further object of the present invention to accomplish the above with no field welding required, other than stud welding.

It is a further object of the present invention to accomplish the above in a system which permits rapid installation.

It is a further object of the invention to provide a site installed connection system which can withstand the significant earth pressures and forces applied to the face of a tiedback wall.

The present invention is directed to a connection system allowing three degrees of freedom of adjustment between a soldier pile and a facing panel of a wall built to retain a cut or excavated earthen face. For convenient reference, the three degrees of freedom will be described with reference to an x-y-z coordinate, as shown in FIG. 3, wherein the x-direction refers to the horizontal direction in the plane of the excavated face, the y-direction refers to the vertical direction in the plane of the excavated face, and the z-direction refers to a direction perpendicular to the plane of the excavated face.

Tiedback walls are commonly used as permanent earth retaining structures for a cut or excavated earthen face. In a typical cut or excavation construction, the wall is built by first installing a plurality of laterally spaced soldier piles, or beams, in the earth along a predetermined position of the wall to be constructed. The soldier piles may have various shapes and usually are either drilled or driven in place. Earth is excavated adjacent the solider piles to a designated depth. Temporary earth retaining apparatus, such as lagging, may be installed as needed between the soldier piles against the exposed face of the earthen mass. The excavating and lagging installation steps are repeated until the earthen mass requires additional reinforcement. A plurality of tiebacks is then installed and anchored in the earthen mass and connected to the soldier piles to further reinforce the earthen mass. The excavating and tieback installation steps are repeated as necessary. When the location for the bottom of the wall is reached, panels are attached to the soldier piles to form the wall. These panels typically are precast, concrete panels, but other types of panels may be used. A reinforced concrete face made from cast-in-place concrete also may be used. The above-described process is typical of a process for building a wall to retain a cut or excavated-type wall to which the invention particularly pertains. Other construction techniques are used for building a "fill-type" wall. Although the connection system of the present invention is intended to be used with a tiedback wall for a cut or excavated earthen face, as described above, other uses may be made as appropriate.

The preferred embodiment of the present invention includes a double T-shaped or a C-shaped bracket having at least two stem portions. The bracket also has vertically elongated slots in its base portion. This bracket is bolted at the excavation site to the soldier pile with threaded fasteners which are welded to the soldier pile. A similarly shaped bracket may be fixed to the concrete facing panel during panel construction or, alternatively, attached at the site. A pair of connecting plates connects the stem portions of the brackets together. The connecting plates may be of variable length. The stem portions of each of the brackets preferably have at least one horizontally elongated slot.

The interrelationship and positioning of the two brackets and connecting plates allows for three degrees of adjustment between the facing panel and the soldier pile and thus facilitates connecting the panel to the soldier pile. Adjustment in the vertical, y-direction is provided by field determination of the location of the threaded fasteners, and hence the bracket, on the soldier pile, and also by the location of the fasteners within the vertically elongated slots in the base portion of the bracket. Adjustment back and forth, that is, in the z-direction, is provided by the length of the connecting plates. Additional adjustments may be obtained by the location of the base of the bracket along the length of the threaded fasteners, i.e., the distance which the base of the bracket is spaced from the face of the soldier pile. This can be accomplished by a retaining nut threaded onto the fasteners on either side of the base portion or by other fastening systems. Preferably, two fasteners are used to attach each bracket to the soldier pile. With two fasteners, the top portion of the bracket may be positioned differently than the bottom portion, thus allowing angular adjustment of the panels with respect to the vertical face of the excavation. Adjustment in the horizontal, x-direction, is provided by the field determined location of the threaded fasteners on the soldier pile, by rotation of the connecting plate between the brackets, and by the horizontally elongated slots in the stems of the brackets. The three degrees of freedom of adjustment provided by the invention permit greater tolerance for misalignment of the soldier piles while simultaneously allowing the accurate placement of the facing panels in a predetermined position. The connection system of the invention provides a sufficiently strong connection to withstand the substantial earth pressures and other forces on the wall and on the connection. The connection system also provides a system in which it is sufficiently easier and faster to set and hold the vertical position of a facing panel.

DETAILED DESCRIPTION OF THE PREFERRED EMBODIMENT

Figure 1:
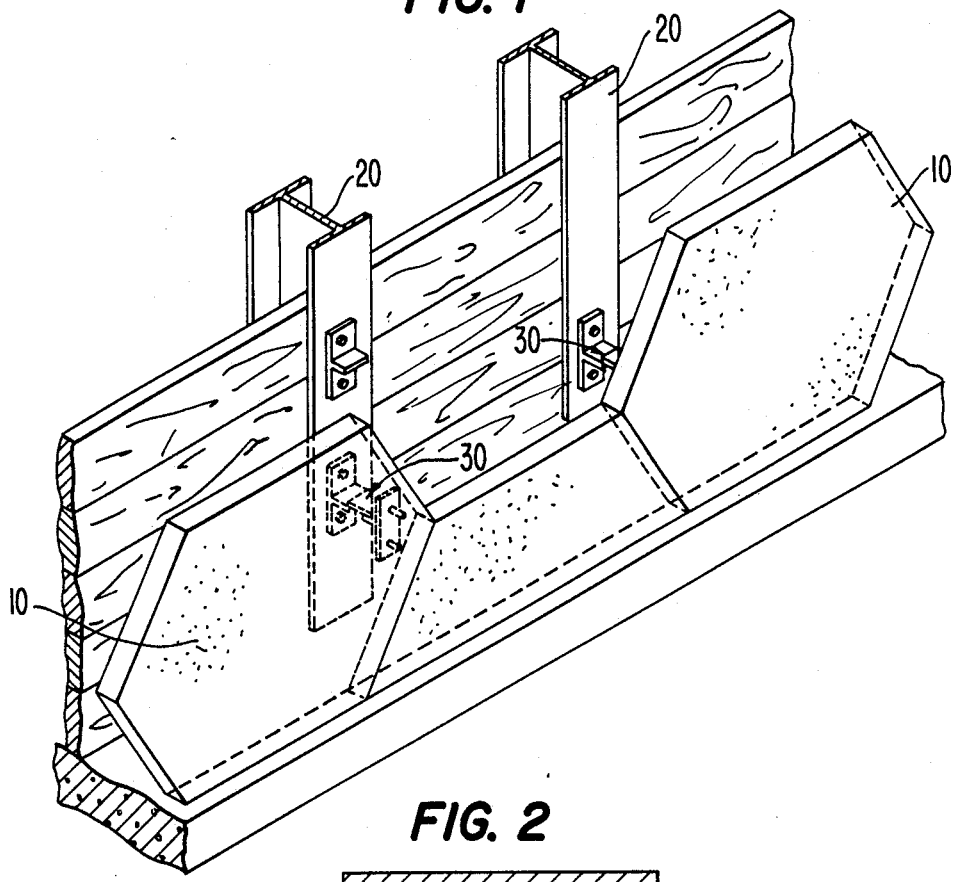
FIG. 1 is a perspective, overall view of the shoring system utilizing a simplified form of a connection system of the present invention in a partially built wall at an excavation site.
Figure 2:
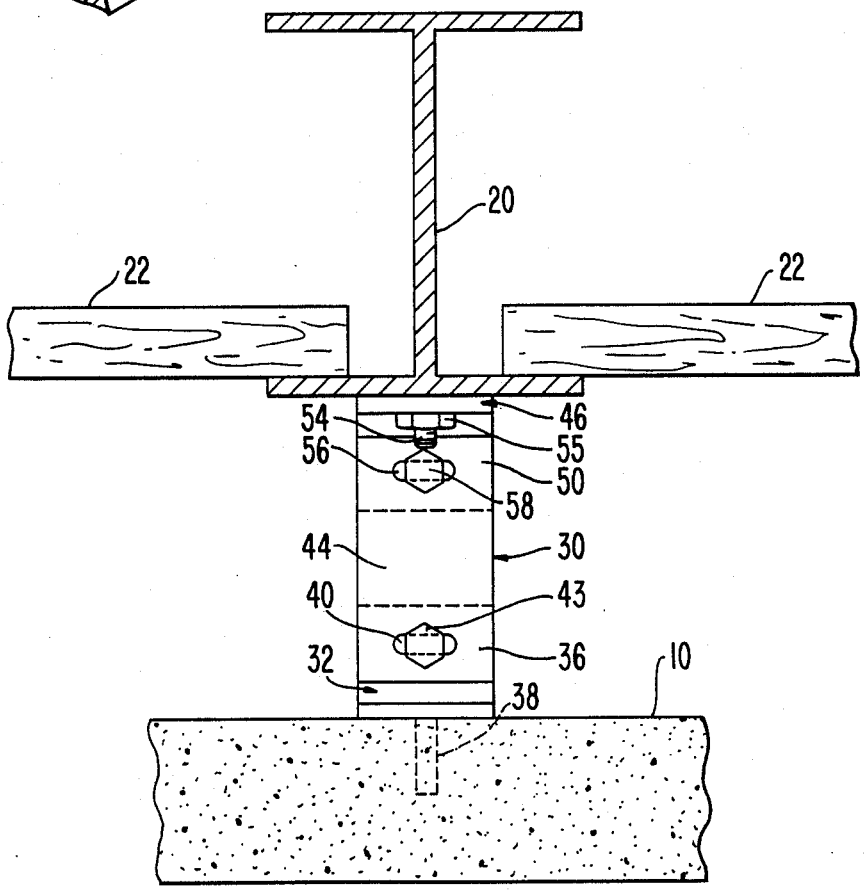
FIG. 2 is a detailed, plan view of the simplified form of the connection system shown in FIG. 1.
Figure 3:
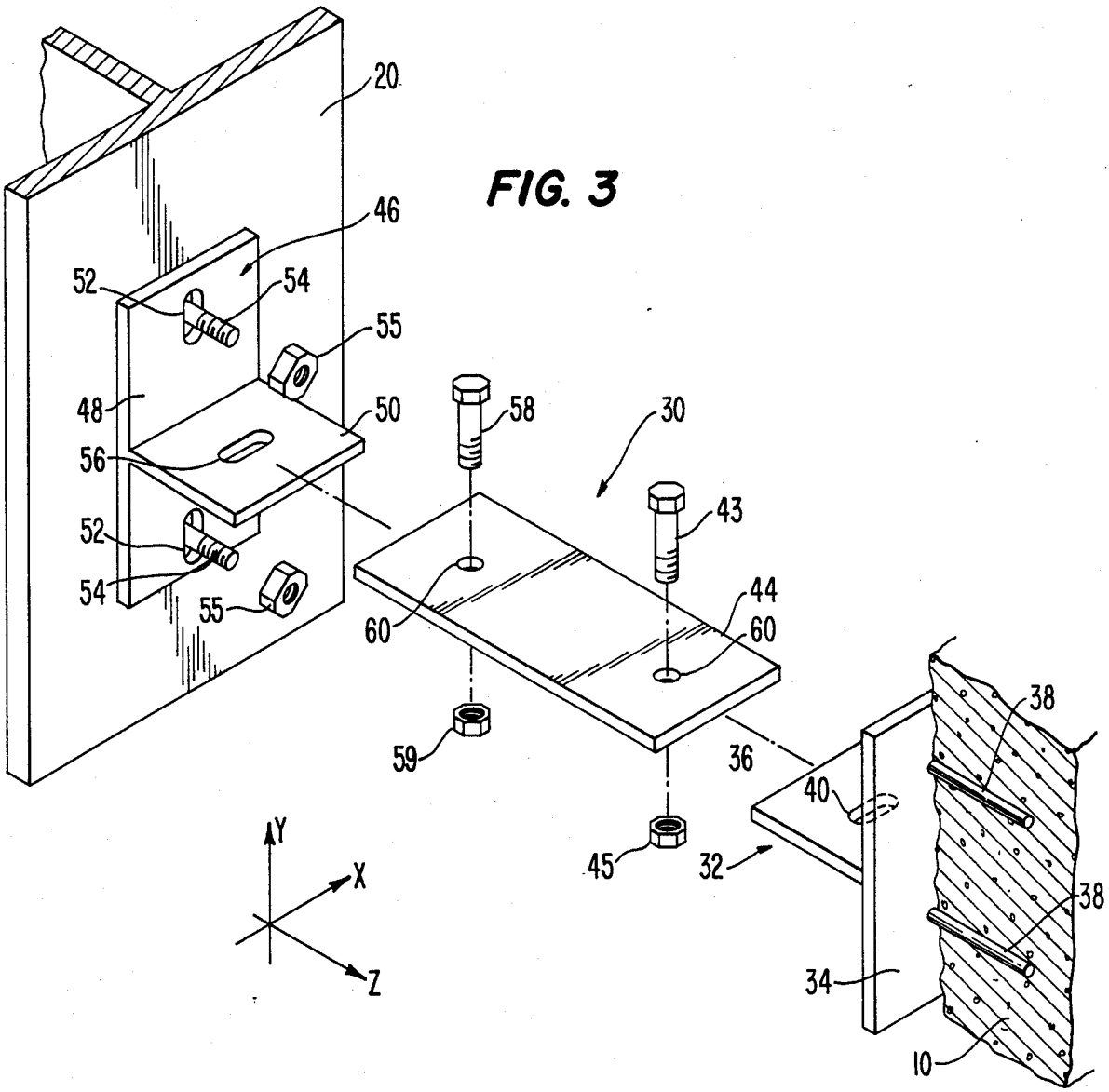
FIG. 3 is an exploded view of the simplified form of the connection system shown in FIG. 2.
Figure 4:
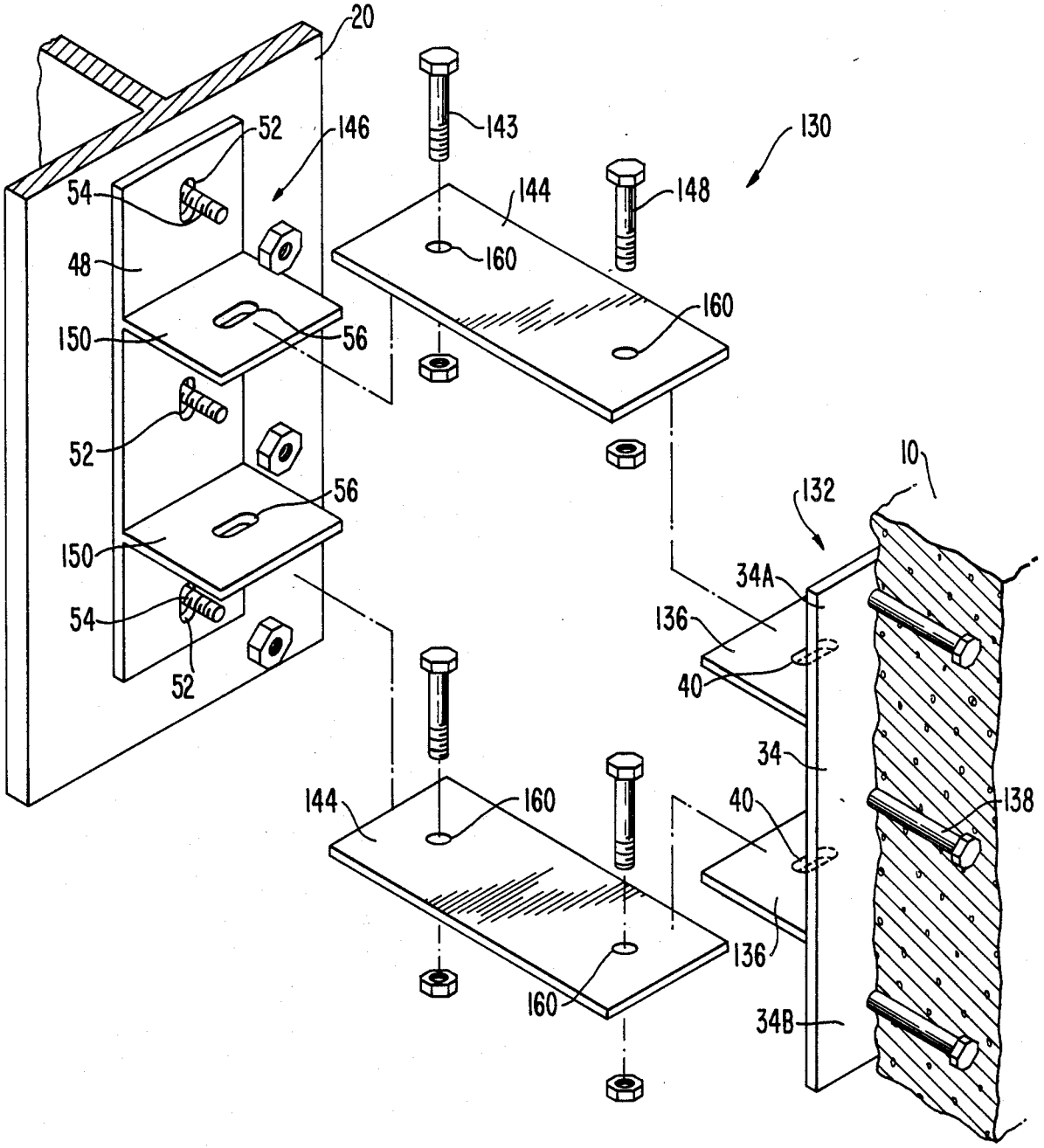
FIG. 4 is an exploded view of the connection system in accordance with a preferred embodiment of the invention.

A simplified form of the connection system in accordance with the present invention, illustrating the basic principles of the invention, is shown in FIGS. 1–3 and generally designated 30. A preferred embodiment of the invention is shown in FIG. 4 and described in detail below.

Connection system 30 adjustably connects facing panels 10 to soldier piles 20. These soldier piles may be of any type and configuration. The facing panels may be of any shape, material, and size, in accordance with site requirements and spacing of the soldier piles. The panels may be conventional precast concrete panels, or may be any other type of panel suitable for use as a retaining wall. Of course, connection system 30 may be used in any excavation support system in which greater tolerance for misalignment is required.

Connection system 30, as shown particularly in FIGS. 2 and 3, includes a first T-shaped bracket 32, having base portion 34 and stem portion 36, coupled to the inside face of facing panel 10, i.e., the face towards soldier pile 20. If a precast, concrete panel is used, base portion 34 is preferably attached by headed shear fasteners 38 to the panel at the time the panel is cast at the manufacturing plant. Fixing bracket 32 to panel 10 during the casting of panel 10 provides enhanced composite strength of the connection which is helpful in withstanding the significant forces and earth pressures required to support a high wall. Alternatively, the panel 10 could be cast with threaded inserts onto which a threaded fastener is inserted at the site. Stem portion 36 of bracket 32 preferably includes at least one horizontally elongated slot 40 permitting adjustment in the x-direction as explained below.

Connection system 30 further includes a second T-shaped bracket 46, having base portion 48 and stem portion 50. Base portion 48 preferably includes at least two vertically elongated slots 52 for connecting bracket 46 to soldier pile 20 while permitting adjustment in the vertical or y-direction. Stem portion 50 preferably includes at least one horizontally elongated slot 56 for providing further adjustment in the x-direction.

A connecting plate 44 interconnects bracket 32 and bracket 46 and thus serves to connect facing panel 10 to soldier pile 20. Connecting plate 44 includes openings 60 to accommodate a threaded fastener, as explained in more detail below. The length of plate 44 may be varied and adjusted at the site to provide adjustability in the z-direction. Additionally, z-direction adjustability is provided by the location of bracket 46 on fastening studs 54.

To install an excavation support system with an adjustable connection system in accordance with the present invention, first, a plurality of soldier piles is installed along a predetermined position of the wall to be constructed. Soldier piles typically are H or I-shaped in cross-section, but can assume any of various shapes and configurations and may be formed of a variety of materials. For example, as disclosed in U.S. Pat. No. 4,369,004, the soldier piles may be channel-shaped sheet piles made of pairs of interlocking steel pile segments. The soldier piles may be installed in the earth either vertically or on a batter in any conventional manner, such as by a pile driver or by being inserted into predrilled holes in the earth and retained in place by concrete. The soldier beams are placed at least as deep as the predetermined bottom of the retaining wall. Preferably, the soldier piles are installed below this level to provide additional stability for the retaining wall.

After the soldier piles have been installed, excavation is commenced to a predetermined depth, usually approximately five feet. Temporary earth retaining apparatus may be installed, if needed, between the soldier piles along the entire length of the retaining wall. Such temporary earth retaining apparatus may comprise conventional wood lagging, shotcrete, gunite, or other well-known material and techniques. These steps are repeated until a depth is reached that requires tiebacks for stability of the earthen mass. At this point, a first level of tiebacks is installed and anchored in the earthen mass. Any type of tieback may be used, but a tieback of the corrosion protected type is preferred for its long lasting strength and integrity. These excavating, tieback installing, and temporary retaining steps are repeated sequentially in descending stages for the full height of the earthen mass. Levelling pads are then preferably poured or set in place to support the vertical weight of the panels.

Next, a first row of facing panels is set in place, spaced from the front face of the excavation. The connection system is then installed, with all the connections made on the back side of the panel. The space between the soldier piles and the panels is filled with a filling material, preferably stones, to permit proper drainage. Additional rows of panels are set, connected and backfilled until the wall is completed. It should be noted that some steps of installing the connection system may be completed before the panels are placed in position, as will be more thoroughly described below.

The step of installing the connection system includes positioning threaded fastener 54 onto soldier piles 20 at the desired location for connecting panel 10 to soldier pile 20. It is in the selection of the position for fastener 54 that the gross x-direction and y-direction adjustments are completed. A stud gun can be used to weld fasteners 54 onto the pile. Bracket 46 is bolted to the fasteners 54 using nuts 55. A second nut (not shown) may be used between the base portion of the bracket and the pile, i.e., behind the bracket, to adjust the position of the bracket in the z-direction. Adjustment may be provided for the lack of "plumbness" of the pile or to angle the face of panel 10, in that, one of the fasteners of the base of the first bracket may be fixed at one distance and another of the fasteners of the base of the first bracket may be fixed at a second distance. If the length of fasteners 54 is insufficient to accommodate for the misalignment of the pile, an extension (not shown) may be coupled to fasteners 54 to increase their length, thus permitting compensation for greater misalignment. Alternatively or additionally, a "standard" length connecting plate 44 may be replaced with a longer or shorter connecting plate. All welding may be completed prior to setting the panels in place. Vertically elongated slots 52 in the base portion 48 of bracket 46 permit fine vertical adjustment of bracket 46 in the y-direction with respect to soldier pile 20. Furthermore, the horizontally elongated slot 56 in stem portion 50 of bracket 46 permits fine adjustment in the x-direction of bracket 46 with respect to connecting plate 44.

Bracket 32 may be secured to the rear face of panel 10, if not fixed in place during casting of panel 10. Instead of installing bracket 32 on panel 10 when the panel is cast, fasteners 38, in the form of threaded inserts, may be embedded in the concrete which would receive a threaded fastener. Bracket 32 would be provided with vertically elongated holes, comparable to holes 52 of bracket 46, and would be adjustably connected to facing panel 10 by the threaded fasteners in the same manner that bracket 46 is adjustably connected to pile 20. This would provide an even greater tolerance for misalignment and mispositioning of the driven soldier pile.

Connecting plate 44 is bolted between stem portion 36 of bracket 32 and stem portion 50 of bracket 46 by fastening bolts 43 and 58 through holes 60 in plate 44 and slots 40 and 56, respectively. The horizontal positioning of plate 44, and hence panel 10 with respect to soldier pile 20, is adjustable within horizontal slots 40 and 56. The interaction between the connecting plate and the horizontally elongated slots in the stems of the brackets permits fine adjustment in the horizontal x-direction. Additionally, some adjustment in the x-direction may be obtained by rotating the connecting plate in the x-z plane about bolts 43 and 58. The final tightening of the nuts 55 on fasteners 54 is preferably left until last, thus completing whatever adjustment in the z-direction is required.

The preferred embodiment of the connection system of the present invention is shown in FIG. 4 in which the same reference numerals are used for like elements. This preferred form has increased strength, rigidity and adjustability over the simplified form previously described. As shown in FIG. 4, connection system 130 includes first bracket 132 having base portion 34 and two stem portions 136, coupled to the inside face of facing panel 10, that is, the face towards soldier pile 20. Base portion 34 is preferably attached by headed shear fasteners 138 at the time the panel is cast at the manufacturing plant. Three fasteners 138 are shown. Alternatively, base portion 34 could be attached by fasteners which are threaded into appropriate inserts which are cast into panel 10. Each of the two stem portions 136 of bracket 132 preferably includes one horizontally elongated slot 40 permitting adjustment in the x-direction. As shown in FIG. 4, bracket 132 base portion 34 and stem portions 136 assume a double-T formation. Bracket 132 could also assume a C-shaped channel configuration in which the upper extension 34A and lower extension 34B of base 34 would be eliminated. The location of fasteners 138 would be adjusted if a C-shaped channel bracket is used.

Connection system 130 includes a second double T-shaped bracket 146, having base portion 48 and two stem portions 150. Bracket 146 also may alternatively assume a C-shaped channel configuration, as described above. Base portion 48 preferably includes at least two vertically elongated slots 52, for connecting bracket 146 to soldier pile 20 while permitting adjustment in the vertical or y-direction. Stem portions 150 preferably include at least one horizontally elongated slot 56 for providing further adjustment in the x-direction.

Two connecting plates 144 interconnect bracket 132 and bracket 146 and thus serve to connect facing panel 10 to soldier pile 20. Connecting plates 144 include openings 160 to accommodate a threaded fastener. Of course, in a similar fashion to the embodiment of FIG. 3, movement in the z-direction is also taken up by the location of bracket 146 on fastener 54 which are fitted through elongated slots 52. As explained above, the length of connecting plates 144 may be varied to provide additional adjustability in the z-direction. The use of two connecting plates not only provides a stronger more rigid connection than the simplified form of the invention shown in FIGS. 1–3, but also provides for greater adjustability. Using two connecting plates allows for greater angular adjustment in the y-z plane, which provides more rigid positioning of panels and allows a wall to be built more than one panel high before backfilling.

The installation of a support system with an adjustable connection system in accordance with this preferred embodiment is similar to the installation of the embodiment of FIG. 3. Of course, two connecting plates 144 are bolted between stem portions 136 of bracket 132 and stem portions 150 of bracket 146 by two sets of fastening bolts 143 and 148 through holes 160 in plates 144 and slots 40 and 56, respectively. Otherwise the installation steps are identical to those previously described.

The foregoing detailed description is for illustrative purposes only. Modifications may be made, within the scope of the invention, as defined by the broad, general meaning of the terms in which the appended claims are expressed. For example, it is contemplated that the brackets could be of various shapes and sizes and are not limited to that shown and described. The brackets also could have several elongated slots on each stem thus permitting a single bracket to connect several panels to a single soldier pile.

I claim:

1. A rigid connection system for adjustably connecting facing panels to soldier piles so as to support the cut face of an excavation and to provide greater tolerance for misalignment of the soldier piles, said system comprising:

a first rigid bracket, said first bracket coupled to the rear face of said facing panel;

a second rigid bracket, said second bracket coupled to the front face of said soldier pile substantially opposite said first bracket;

at least one rigid connecting plate, said connecting plate being coupled between said first bracket and said second bracket, and adjustment means provided by said first bracket, said second bracket and said rigid connecting plate for providing three degrees of adjustment between said soldier pile and said facing panel.

2. The connection system as recited in claim 1 wherein said adjustment means comprises first adjustment means for adjusting the vertical and horizontal position of said second bracket with respect to the soldier pile, second adjustment means for adjusting the horizontal position of said connecting plate with respect to both said first bracket and said second bracket, and third adjustment means for accommodating the perpendicular distance between said facing panel and said soldier piles.

3. The connection system as recited in claim 2 wherein said first adjustment means comprises at least one threaded fastener selectively positionable vertically and horizontally on the soldier pile and at least one vertically oriented slot in said second bracket whereby said threaded fastener is selectively positionable and fixed within said vertically oriented slot to further vertically fix said second bracket with respect to the soldier pile.

4. The connection system as recited in claim 3 wherein said second adjustment means comprises at least one horizontally oriented slot in each of said first and second brackets whereby said connecting plate is selectively positionable and fixed to said brackets through said horizontally oriented slots to thereby horizontally fix the horizontal position of said connecting plate with respect to each of said brackets.

5. The connection system recited in claim 4 wherein said third adjustment means comprises fastening means for selectively positioning said second bracket on said threaded fasteners whereby said second bracket can be selectively spaced from the soldier pile.

6. The connection system recited in claim 4 wherein said third adjustment means comprises connecting plates of varying lengths.

7. The connection system as recited in claims 5 or 6 wherein said second bracket is T-shaped having a base portion and a stem portion substantially perpendicular to said base portion, said base portion of said second bracket adapted to be positioned adjacent the soldier pile, said vertically oriented slot being in said base portion and said horizontally oriented slot being in said stem portion, and wherein said first bracket is T-shaped having a base portion and a stem portion substantially perpendicular to said base portion, said base portion of said first bracket adapted to be positioned adjacent the panel, said horizontally oriented slot being in said stem portion.

8. The connection system as recited in claims 5 or 6 wherein said first bracket has a base portion and two stem portions substantially perpendicular to said base portion, said base portion of said first bracket adapted to be positioned adjacent and fixed to the facing panel, and wherein said second bracket has a base portion and two stem portions substantially perpendicular to said base portion, said base portion of said second bracket adapted to be positioned adjacent and fixed to the soldier pile.

9. A method of connecting facing panels to soldier beams in a wall retaining an excavated earthen mass comprising the steps of:

installing a plurality of laterally spaced soldier piles in the earth along a predetermined position of the wall to the constructed;

excavating earth adjacent to said soldier piles to a desired depth thus creating a cut face;

setting facing panels having a first rigid bracket fixed to the rear side of the facing panels in place to form a wall spaced from said cut face;

adjustably fixing a plurality of second rigid brackets to the front side of the soldier piles so that said second brackets are selectively positionable in three degrees of freedom with respect to the soldier pile and said second brackets are positioned substantially opposite the first brackets; and adjustably fixing a rigid connecting plate between each of said first and second brackets to thereby adjustably connect each of said panels to a soldier pile while allowing three degrees of freedom of adjustment between the soldier pile and facing panels to provide greater tolerance for misalignment.

10. The method as recited in claim 9 wherein the step of fixing the second bracket to the soldier pile comprises:

determining the desired position of said second bracket on the soldier pile, fixing fasteners to the soldier pile at the determined position, providing first adjustment slots in said second bracket, fixing said second bracket on the soldier pile by selectively positioning said second bracket on the fasteners extending through the first adjustment slots and by selectively placing said second bracket at the desired position along the length of the fastener.

11. The method as recited in claim 10 wherein said first and second brackets comprise second adjustment slots and wherein the step of fixing said connecting plate between said brackets comprises selectively positioning and fixing said connecting plate within said second adjustment slots.

12. A rigid connection system for adjustably connecting facing panels to soldier piles so as to support the cut face of an excavation and to provide greater tolerance for misalignment between the soldier pile and facing panel, ease of construction, and improved strength, said system comprising:

a first rigid bracket having a base portion and two stem portions substantially perpendicular to said base portion, said base portion adapted to be positioned and fixed to the rear side of the facing panel;

a second rigid bracket having a base portion and two stem portions substantially perpendicular to said base portion, said base portion adapted to be positioned and fixed to the front side of the soldier pile substantially opposite said first brackets;

rigid connecting means for coupling said first bracket and said second bracket; and adjustment means for providing for three degrees of adjustment between said soldier pile and said facing panel.

13. The connecting system as recited in claim 12 wherein said adjustment means comprises:

first adjustment means for adjusting the vertical and horizontal position of said second bracket with respect to said soldier pile, second adjustment means for adjusting the horizontal position of said connecting means with respect to both said first bracket and said second bracket, and third adjustment means for accommodating the perpendicular distance between said facing panels and said soldier piles.

14. The connection system as recited in claim 13 wherein said first adjustment means comprises at least one fastener selectively positionable vertically and horizontally on the soldier pile and at least one vertically oriented slot in said second bracket whereby said fastener is selectively positioned and fixed within said vertically oriented slots to further vertically fix said second bracket with respect to the soldier pile.

15. The connection system as recited in claim 14 wherein said second adjustment means comprises at least one horizontally oriented slot in each stem of said first and second brackets whereby said connecting plates are selectively positioned and fixed to said brackets through said horizontally oriented slots to thereby horizontally fix the horizontal position of said connecting plates with respect to each of said brackets.

16. The connection system as recited in claim 15 wherein said third adjustment means comprises fastening means for selectively positioning said second bracket on said fasteners whereby said second bracket can be selectively spaced from the soldier pile.

17. The connection system as recited in claim 15 wherein said connecting means are connecting plates and wherein said third adjustment means comprises connecting plates of varying lengths.

18. The connection system as recited in claim 12 wherein said connection means comprises connecting plates fastened between the stem portions of said first and second brackets.

19. The connection system as recited in claim 18 wherein the perpendicular distance between each of said stem portions of said first and second brackets may be varied individually thereby providing angular adjustment between the facing panel and soldier pile.

* * * * *